United States Patent [19]

Gortowski

[11] 4,023,790

[45] May 17, 1977

[54] SCORING ATTACHMENT FOR BUCKLE FOLDING APPARATUS

[76] Inventor: Donald A. Gortowski, P.O. Box C, Barrington, N.J. 08007

[22] Filed: Jan. 26, 1976

[21] Appl. No.: 652,636

[52] U.S. Cl. ..... 270/68 A; 270/21

[51] Int. Cl.[2] ..... B65H 45/14

[58] Field of Search ..... 270/68 R, 68 A; 93/1 G, 93/58.1, 84 R; 83/11–12, 902

[56] References Cited

UNITED STATES PATENTS 3,157,398 11/1964 Zahradnik ..... 270/68 A

*Primary Examiner*—Edgar S. Burr

*Assistant Examiner*—A. Heinz

*Attorney, Agent, or Firm*—Duffield & Lehrer

[57] ABSTRACT

A paper-scoring attachment for use in buckle type paper folding apparatus which includes two parallel scoring rollers journaled in roller supporting frames. The attachment is fitted to the fold pan rails of the buckle type folder in place of the fold pans and positioned adjacent the first folding roller pair to permit scoring of paper stock passing through the first folding roller pair. The scoring rollers are driven by an idler gear secured to one supporting frame which gear engages the gear train of the conventional buckle type paper folder.

6 Claims, 5 Drawing Figures

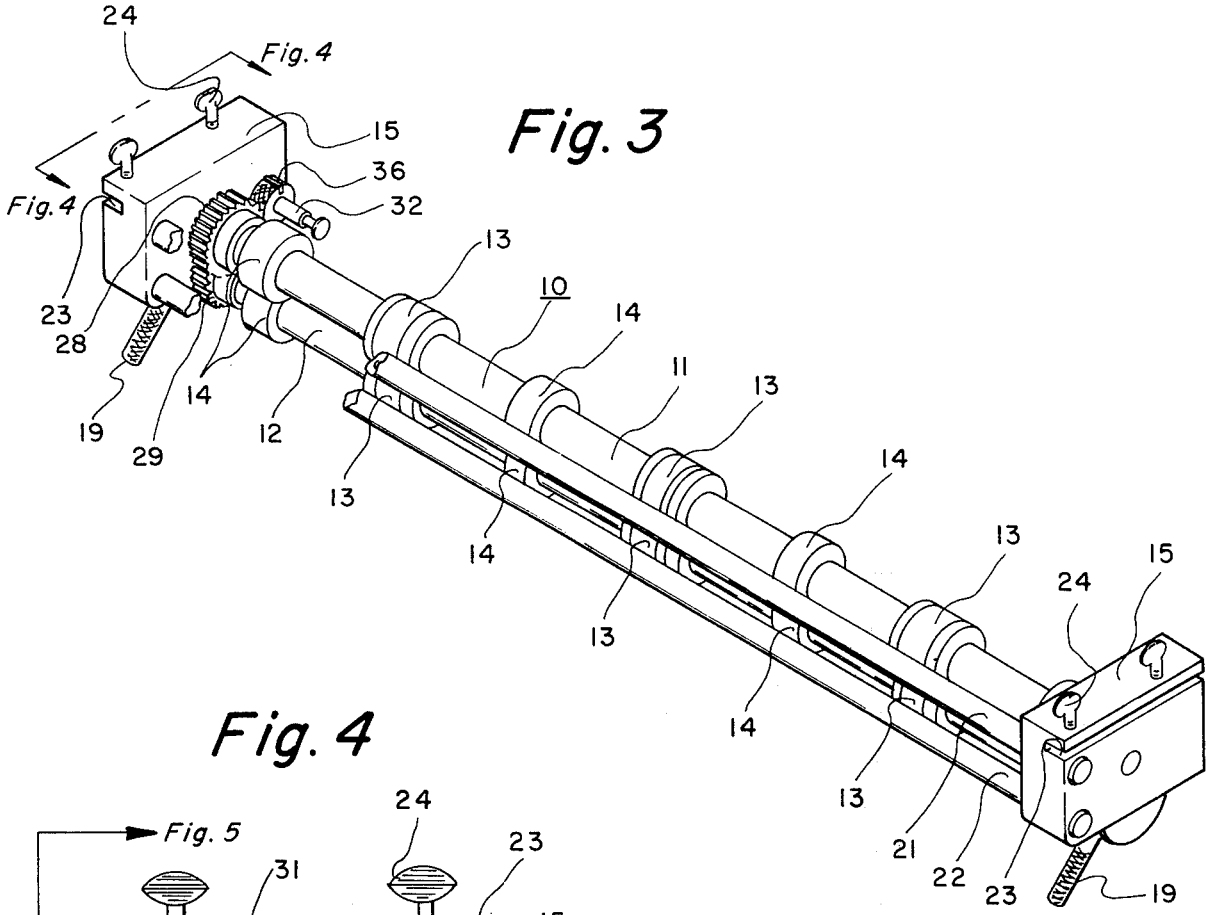
Fig. 3
Fig. 4
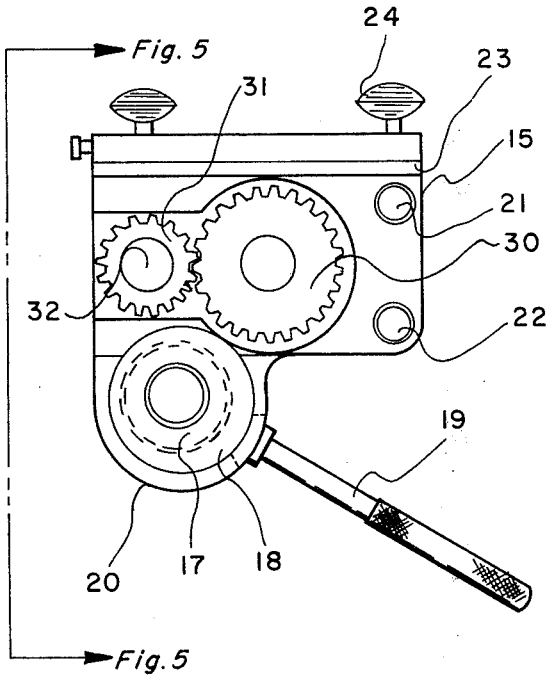
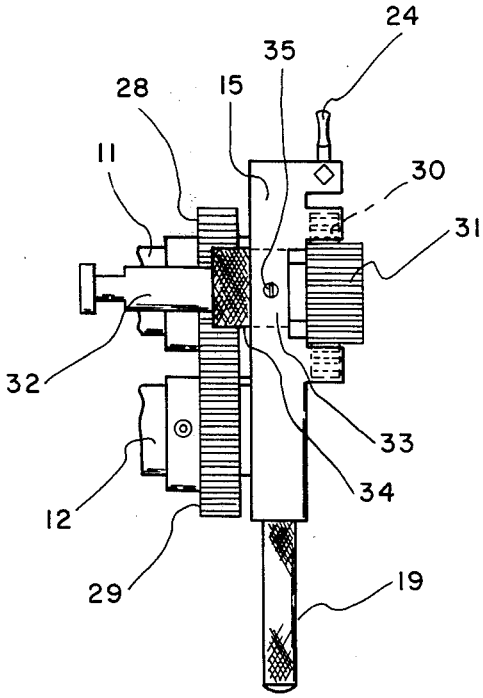
Fig. 5

SCORING ATTACHMENT FOR BUCKLE FOLDING APPARATUS

BACKGROND OF INVENTION

The printing and publishing industry has long used folding machines to fold printed paper stock into many different configurations. Examples of manufacturers of such equipment are O & M Machinery, Inc., Stahl Folding Machines, Cleveland Folding Machines and the Baumfolder Division of Bell & Howell Company.

These general purpose paper-folding machines typically employ a first roller assembly which includes many folding rollers which operate in conjunction with fold pans supported on parallel fold pan rails at differing levels adjacent the folding rollers. Paper stock passing through the folding rollers will emerge given roller pairs and engage the fold pans whereupon the stock buckles and returns through the next folding roller pair.

Different adjustments on the fold pans will result in different folding configurations occurring in the first roller assembly. The typical buckle folding machines to which the present invention applies also include an additional second roller assembly and, in some cases, a third roller assembly positioned such that the paper stock will pass from one assembly to another.

In some applications, it is necessary to score the paper stock prior to passing through one of the roller assemblies. The typical buckle folding machine will have a scoring roller pair as the last rollers in the first roller assembly.

In those folding applications where scoring of the stock is required, the fold pans will be set such that the stock will pass completely through the first roller assembly without being folded whereupon it will encounter the scoring roller pair. One of the problems encountered in this sequence is that the paper, in passing through the numerous rollers of the first roller assembly before being scored, is often shifted in alignment and is subjected to breaking of the paper fibers. This results in a less perfect and desirable fold when the stock is passed through the folding rollers in the second and subsequent roller assemblies.

OBJECT AND SUMMARY OF INVENTION

It is the object of the present invention to provide an attachment for buckle-type folding apparatus which can be utilized with the conventional buckle-type folder without alteration thereof and which will permit scoring of the paper stock in the beginning of the first roller assembly and permit the paper stock to be discharged directly to the second roller assembly without the necessity of passing through the remaining roller pairs of the first roller assembly.

The present invention carries out the foregoing object by the utilization of an attachment for the conventional buckle type folders which includes two parrallel scoring rollers which are journaled in two end supporting frames. The supporting frames include transverse slots therein which are adapted to fit into the parallel fold pan rails of the first roller section after the fold pans ave been removed.

Drive gears interconnect the two scoring rollers and one of the scoring rollers is, in turn, driven by an idler gear which is adapted to engage one of the drive gears of the drive train for the folding rollers of the first roller assembly.

Other objects and advantages of the present invention will become apparent to those skilled in the art in view of the detailed description thereof which follows taken in conjunction with the drawings.

DESCRIPTION OF DRAWINGS

FIG. 3 is a perspective view of the scoring attachment of the present invention;

FIG. 4 is an end view of the scoring attachment of the present invention taken along the line 4—4 in FIG. 3; and, FIG. 5 is a front view of a portion of the scoring attachment of the present invention taken along the line 5—5 of FIG. 4.

DETAILED DESCRIPTION OF INVENTION

Figure 1:
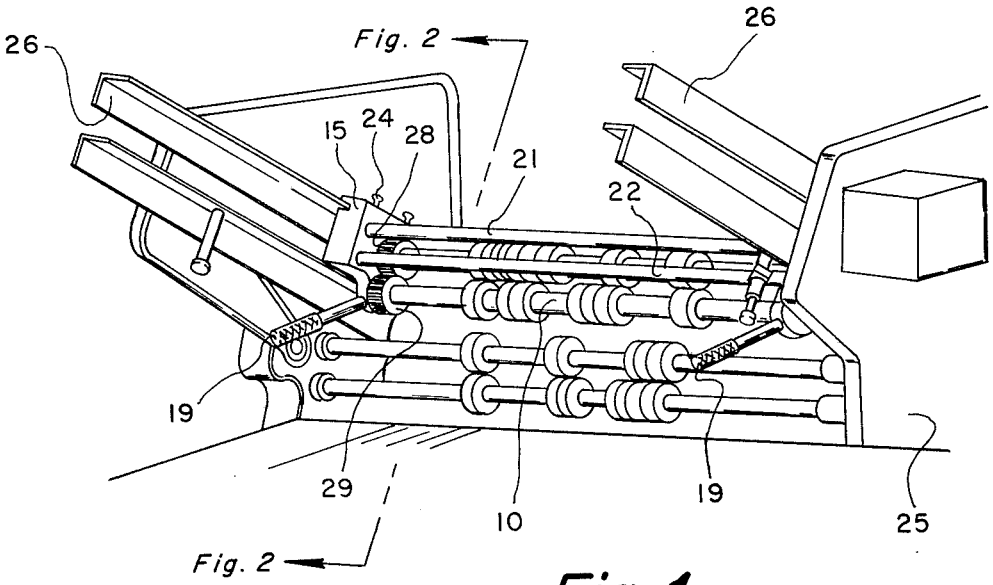
FIG. 1 is a perspective view of a portion of a typical buckle type folding machine showing the attachment of the present invention in place.

The entire scoring attachment of the present invention is shown free standing in the FIG. 3 of the drawing and in place in a typical buckle folding apparatus in FIG. 1. The attachment 10 includes a pair of parallel roller assemblies which are formed of roller shafts 11 and 12 and a plurality of opposed scoring wheels 13. The scoring wheels 13 are of a conventional nature and are adapted for lateral adjustment along the scoring shaft. Additionally, the scoring wheels may be designed for male scoring or female scoring and of different desired configurations as circunstances require. The scoring shafts 11 and 12 also support a plurality of drive wheels 14 for transferring the paper stock through the scoring wheel assembly.

Figure 2:
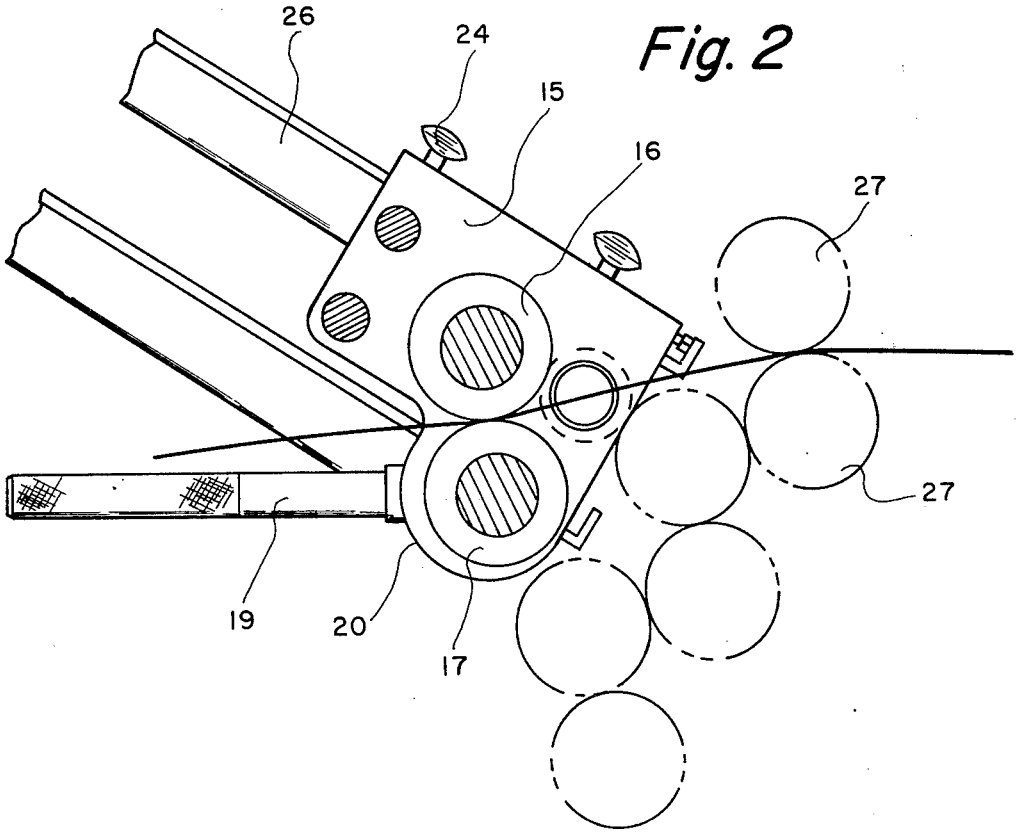
FIG. 2 is an end view partially in section of the attachment of the present invention taken along the line 2—2 of FIG. 1.

A roller supporting frame 15 is provided at either end of the scoring shafts 11 and 12. As best seen in FIG. 2, the upper scoring shaft 11 is journaled at either end in a bearing or journal 16 secured in the supporting frame 15. In a like manner, the lower scoring shaft 12 is secured into a like journal or bearing 17 positioned in the supporting frame 15.

As best seen in FIGS. 2 and 5, the lower bearings or journals 17 are mounted into an eccentric 18 positioned in both supporting frames. The eccentrics 18 may be rotated by means of a handle 19 which is secured into the eccentric and operates through a slot (not shown) in the lower boss 20 of each supporting frame. Adjustment of the handles 19 through the rotation of the eccentric adjusts the separation or spacing through the scoring wheels 13 to accommodate paper of different thicknesses.

As best seen in FIG. 3, an upper supporting rod 21 and a lower supporting rod 22 are provided. These two rods are anchored at the respective ends into the roller supporting frames 15 to provide rigidity to the assembly.

Each roller supporting frame 15 includes a transverse slot 23 in the upper outside face thereof as shown in FIG. 3. A pair of wing nuts 24 are threaded into fully threaded apertures in the upper surface of each roller supporting frame 15. The wing nuts are of sufficient length such that the wing nuts will pass into the slot 23.

In accordance with the present invention, as best shown in FIG. 1, the conventional fold pans are removed from the first roller assembly of a typical buckle type folder 25. The scoring attachment 10 is then positioned upon the upper pair of fold pan rails 26 by engaging the fold pan rails 26 with the transverse slots 23 in the supporting frames 15 and sliding the scoring attachment 10 down the rails until the scoring attachment is positioned adjacent the first pair of folding rollers 27 as shown more in detail in FIG. 2. Once the scoring attachment 10 is properly positioned, it is locked in place on the fold pan rails 26 by means of the pair of wing nuts 24 associated with each supporting frame 15. In this manner, the paper stock is passed through the first roller pair 27 and directly into the scoring rollers assemblies 11 and 12 from which the scored paper stock is passed directly to the next roller assembly without having to pass through the remaining roller pairs which produce the previously discussed misalignment and cracking.

As best shown in FIG. 5, the upper scoring shaft 11 and lower scoring shaft 12 are geared together for rotation by means of a spur gear 28 secured to the upper scoring shaft 11 and a second spur gear 29 of the same number of teeth connected to the lower scoring shaft 12. The upper scoring shaft 11 extends through the left-hand supporting frame 15, as best seen in FIGS. 4 and 5. A driven gear 30 is secured upon the right hand end of the upper scoring shaft 11.

An idler gear 31 is positioned forward of the driven gear 30 and in mesh with the driven gear 30. The idler gear 31 is journaled upon an idler shaft 32 as best shown in FIG. 5. The idler shaft 32 is positioned in the roller frame 15 by means of an enlarged spindle 34 which is positioned within a boss 33 in the side portion of the roller frame.

The dimensions of the spindle 34 and boss 33 are such as to permit longitudinal movement of the spindle 34 and its included idler gear 31 relative to the boss 33. A set screw 35 positioned in the supporting frame 15 engages a keyway 36 on the spindle to maintain the spindle and its associated idler gear 31 in place. This arrangement permits longitudinal positioning of the idler gear in order that the gear teeth of the gear may be manually aligned with and engage one of the drive train gears already positioned on the existing conventional folding apparatus. Additionally, the set screw and keyway arrangement permits removal of the idler gear.

The particular radial gear mesh between the idler gear 31 and the drive train can further be adjusted and fixed by means of positioning of the side frames 15 on the fold pan rails and locked in place by means of the wing nuts 24.

While the scoring attachment has been shown as driven from a machine having a right hand roller drive train, it is contemplated that the arrangement drive gears 28, 29, 30 and 31 can all be positioned on the opposite end of the attachment so as to be driven by a machine having a left hand roller drive train.

From the foregoing, it will be appreciated that the scoring attachment of the present invention provides a convenient attachment for existing folding apparatus which will permit scoring of paper stock at the beginning of the first roller assembly and thus avoid the problems of misalignment and paper stock cracking which occurs with scoring rollers positioned at the end of the first roller assembly of conventional buckle type folding apparatus.

The scoring attachment of the present invention has been described in respect to a particular embodiment thereof shown in the drawings. It is to be understood that no limitation of the scope of the invention was intended by the specific embodiment thereof shown and described inasmuch as other variations and modifications to the invention will now become apparent to those skilled in the art in view of the foregoing disclosure. Therefore, the scope of the invention is to be interpreted in view of the appended claims.

I claim:

1. In a buckle-type paper folder of the type having a first folding roller assembly including a plurality of folding roller pairs driven by a folder drive chain and parallel fold pan rails for supporting fold pans adjacent the folding rollers, the improvements of a scoring attachment permitting scoring of paper stock at the beginning of passage of the paper stock through the first folding roller assembly comprising:

two parallel scoring rollers;

a roller supporting frame at each end of the scoring rollers including journal means supporting the rollers between the supporting frames;

securing means for removably supporting the roller supporting frames and included scoring rollers upon the fold pan rails adjacent the folding rollers; and, roller drive means interconnecting at least one scoring roller with the folder drive train to drive the scoring rollers.

2. The improvements of claim 1 wherein the roller drive means includes two gears between the two scoring rollers.

3. The improvements of claim 2 wherein the roller drive means further includes an idler gear which engages both the folder drive train and one of the two gears for the scoring rollers.

4. The improvements of claim 3 wherein the idler gear includes means for shifting the idler gear for alignment with the folder drive train.

5. The improvements of claim 1 wherein the securing means for the roller supporting frames includes an elongate slot in each roller supporting frame extending transverse to the axis of the scoring rollers and adapted to engage the fold pan rails and further including threaded fastening means threaded into the supporting frames and adapted to engage the pan rails to lock the supporting frames in place.

6. The improvements of claim 1 wherein the journal means supporting one of the two scoring rollers further includes eccentric means for adjusting the spacing between the two scoring rollers.

* * * * *

UNITED STATES PATENT OFFICE

CERTIFICATE OF CORRECTION

Patent No. 4,023,790 Dated May 17, 1977

Inventor(s) Donald A. Gortowski

It is certified that error appears in the above-identified patent and that said Letters Patent are hereby corrected as shown below:

Column 2, line 33 "circunstances" should be --circumstances--.

Column 4, line 20 "chain" should be --train--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*